US008506355B1

(12) United States Patent
Patterson

(10) Patent No.: US 8,506,355 B1
(45) Date of Patent: Aug. 13, 2013

(54) SYSTEM AND METHOD FOR IN-SITU INSPECTION DURING METALLURGICAL CROSS-SECTIONING

(75) Inventor: Joseph Martin Patterson, Carlsbad, CA (US)

(73) Assignee: Applied Micro Circuits Corporation, Sunnyvale, CA (US)

( * ) Notice: Subject to any disclaimer, the term of this patent is extended or adjusted under 35 U.S.C. 154(b) by 704 days.

(21) Appl. No.: 12/651,798

(22) Filed: Jan. 4, 2010

(51) Int. Cl.
*B24B 49/00* (2012.01)

(52) U.S. Cl.
USPC ..... 451/6; 451/8; 451/285

(58) Field of Classification Search
USPC ..... 451/5, 6, 8, 285
See application file for complete search history.

(56) References Cited

U.S. PATENT DOCUMENTS 3,568,377 A * 3/1971 Blohm et al. ..... 451/444
4,459,785 A * 7/1984 Zimmer ..... 451/398
4,802,160 A * 1/1989 Yamada et al. ..... 369/284
5,800,254 A * 9/1998 Motley et al. ..... 451/285
6,168,508 B1 * 1/2001 Nagahara et al. ..... 451/527
6,171,181 B1 * 1/2001 Roberts et al. ..... 451/527
6,368,182 B2 * 4/2002 Dvir et al. ..... 451/6
6,387,312 B1 * 5/2002 Roberts et al. ..... 264/328.16
6,586,337 B2 * 7/2003 Parikh ..... 438/692
6,840,843 B2 * 1/2005 Jones et al. ..... 451/41
6,855,034 B2 * 2/2005 Hasegawa ..... 451/41

OTHER PUBLICATIONS

Hunt et al., "Automated Serail-Section Polishing Tomography", Proceedings from the 34th International Symposium for Testing and Failure Analysis, pp. 21-24, 2008.

* cited by examiner

*Primary Examiner* — Maurina Rachuba
(74) *Attorney, Agent, or Firm* — Turocy & Watson, LLP

(57) ABSTRACT

A system and method are provided for in-situ inspection optical inspection during a parallel polishing process. The method provides a polishing device with a spindle bit for holding a metallurgical sample, and a rotatable wheel having an inner diameter with a top surface for accepting a polishing compound and a transparent outer diameter. An optical system underlies the wheel outer diameter for recording images of the metallurgical sample. The method polishes the metallurgical sample against the wheel inner diameter. Without releasing the metallurgical sample from the spindle bit, the metallurgical sample is moved to a first position overlying the wheel outer diameter, and the metallurgical sample is optically inspected. In one aspect, the polishing device has a cleaning system overlying the wheel outer diameter, and the method sprays the wheel outer diameter with cleaning solution to support an in-situ inspection.

10 Claims, 4 Drawing Sheets

SYSTEM AND METHOD FOR IN-SITU INSPECTION DURING METALLURGICAL CROSS-SECTIONING

BACKGROUND OF THE INVENTION

1. Field of the Invention

This invention generally relates to metallurgical polishing and, more particularly, to a system and method that permits in-situ visual inspection of a metallurgical sample during polishing operations.

2. Description of the Related Art

As a sample is being cross-sectioned, it needs to be viewed many times during the process. Polishing must be stopped periodically and the sample placed on a microscope for examination to document the progress, look for anomalies, and photo document findings. If there are infrequent inspections, defects can be missed by polishing through them between examination steps. Alternately, if there are a large number of viewing steps, the polishing process becomes extremely slow.

Thus, the polishing process is labor intensive, requiring considerable time and continuous attention. Even automated polishing systems need to be stopped periodically to examine the sample on a microscope. For inspection, the sample needs to be removed from the polishing chuck, carried to a microscope for inspection, and then returned to the chuck for the next iteration of polishing.

One solution to the above-mentioned problem automates the removal of the sample from the polishing apparatus by having the sample attached to an arm, see Hunt et al., *Automated Serial-Section Polishing Tomograph*, Proceedings from the 34$^{th}$ International Symposium for Testing and Failure Analysis, November 2-6, Portland, Oreg., pp. 21-24. The arm lifts the sample over to a microscope for inspection. Besides being a rather cumbersome operation, the samples need to be rinsed and dried before examination.

It would be advantageous if a metallurgical sample could be inspected in-situ, without removing the sample from the polishing apparatus.

SUMMARY OF THE INVENTION

Disclosed herein are a system and method that permit the continuous examination of metallurgical cross-sections while in process, without significant interruption. In addition to speeding up the cross-section process, the disclosed system and method permit the process to be automated, and to support comprehensive documentation. The process incorporates microscopic examination into the polishing wheel apparatus so that the sample is left in place and can be examined without interrupting the polishing process. The polishing can be continuously monitored with real-time photos or video.

Inspections are performed using an oversized glass polishing wheel, with optical coupling, e.g., utilizing fiber optics or mirrors, through the bottom of the glass wheel to a microscope. A camera may be attached to the microscope, and connected to a computer for image capture and processing. Continuous viewing access to the samples' polished surface is supported during the entire polishing process without interruption.

Accordingly, a method is provided for in-situ inspection optical inspection during a parallel polishing process. The method provides a polishing device with a spindle bit for holding a metallurgical sample, and a rotatable wheel having an inner diameter with a top surface for accepting a polishing compound and a transparent outer diameter. An optical system underlies the wheel outer diameter for recording images of the metallurgical sample. The method polishes the metallurgical sample against the wheel inner diameter. Without releasing the metallurgical sample from the spindle bit, the metallurgical sample is moved to a first position overlying the wheel outer diameter, and the metallurgical sample is optically inspected.

In one aspect, the polishing device has a cleaning system overlying the wheel outer diameter, and the method sprays the wheel outer diameter with cleaning solution to support an in-situ inspection. For example, the wheel outer diameter may be made of glass and the optical system includes a lens underlying the wheel outer diameter, focused on the first position. Then, a continuous stream of water may be supplied during the optical inspection, between a wheel outer diameter top surface and the first position, and between a wheel outer diameter bottom surface and the lens. Thus, the optically inspection of the metallurgical sample is conducted through water and glass mediums having matching indices of refraction.

Additional details of the above-described method; and a parallel polishing device with an in-situ optical inspection system, are provided below.

DETAILED DESCRIPTION

Figure 1A:
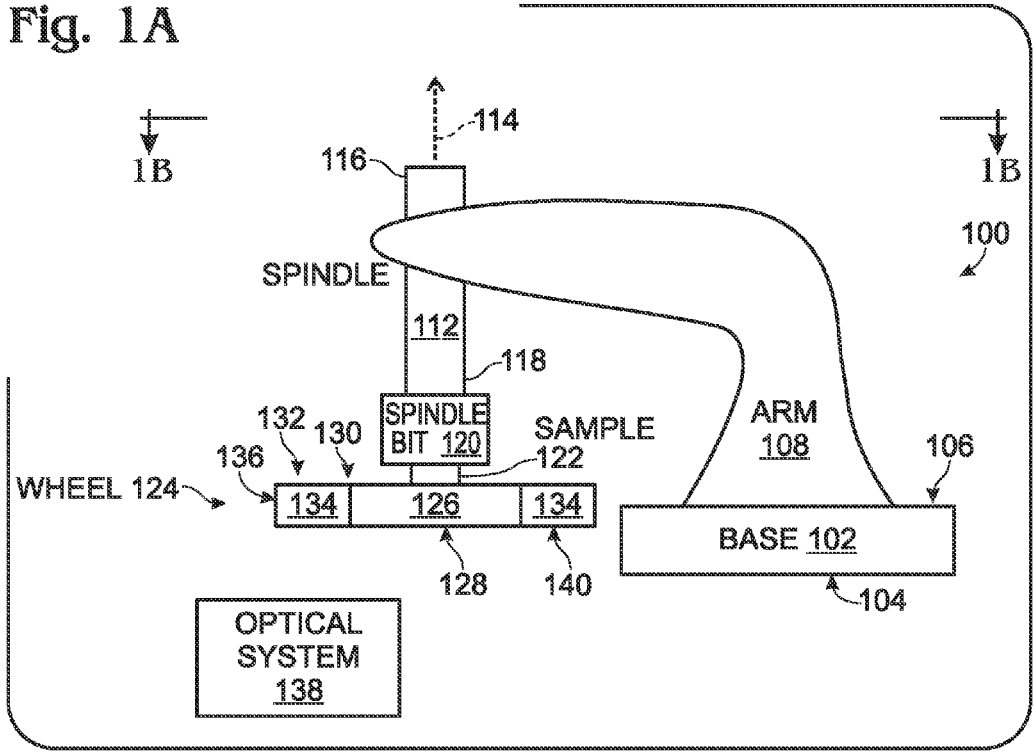
FIGS. 1A and 1B are partial cross-sectional and plan views, respectively, of a parallel polishing device with an in-situ optical inspection system.
Figure 1B:
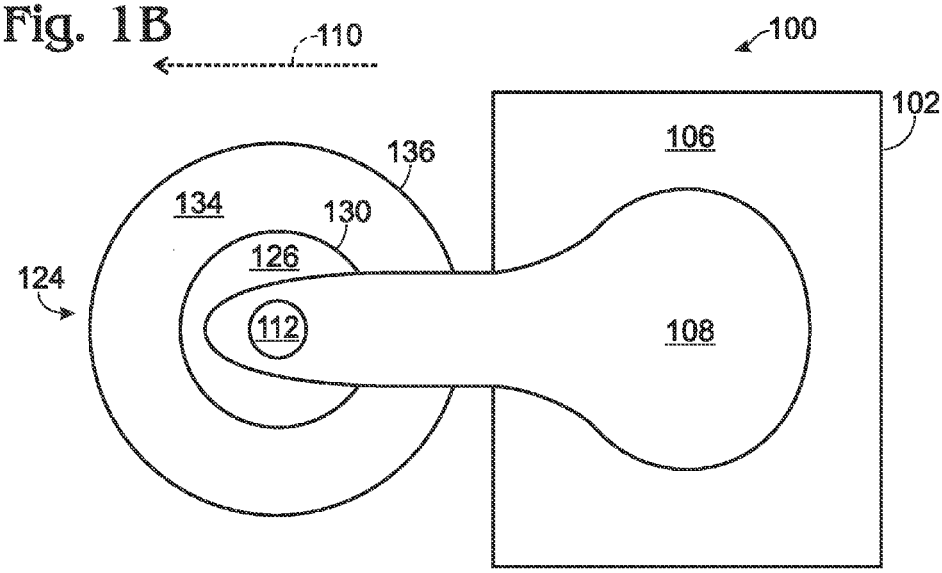

FIGS. 1A and 1B are partial cross-sectional and plan views, respectively, of a parallel polishing device with an in-situ optical inspection system. The figures depict the device performing a polishing operation. The device 100 comprises a base 102 with a bottom surface 104 for table mounting, and a top surface 106. An arm 108 is mounted on the base top surface 106, moveable in a horizontal plane 110. The device 100 includes a spindle 112 moveable in a vertical plane 114, with a proximal end 116 extending from the arm, and a distal end 118. A spindle bit 120 is attached to the distal end 118 of the spindle 112 for holding a metallurgical sample 122. A rotatable wheel 124 underlies the spindle bit 112 having an inner diameter 126 between the center 128 of the wheel and an inner circumference 130, with a top surface 132 for accepting a polishing compound. For example, the wheel may be turned by a belt, motor shaft, or turntable, not shown. It should be noted that there are a number of equivalent polishing devices that would support an in-situ optical inspection system that perform the same functions as the exemplary device described above. The in-situ optical inspection system is not limited to any particular type of polisher design.

The wheel 124 has a transparent outer diameter 134 between the inner circumference 130 and the outer edge 136 of the wheel. A transparent wheel is not a conventional component of a polishing device. An optical system 138 underlies the outer diameter 134 of the wheel bottom surface 140. The optical system 138 records images of the metallurgical sample.

Figure 2:
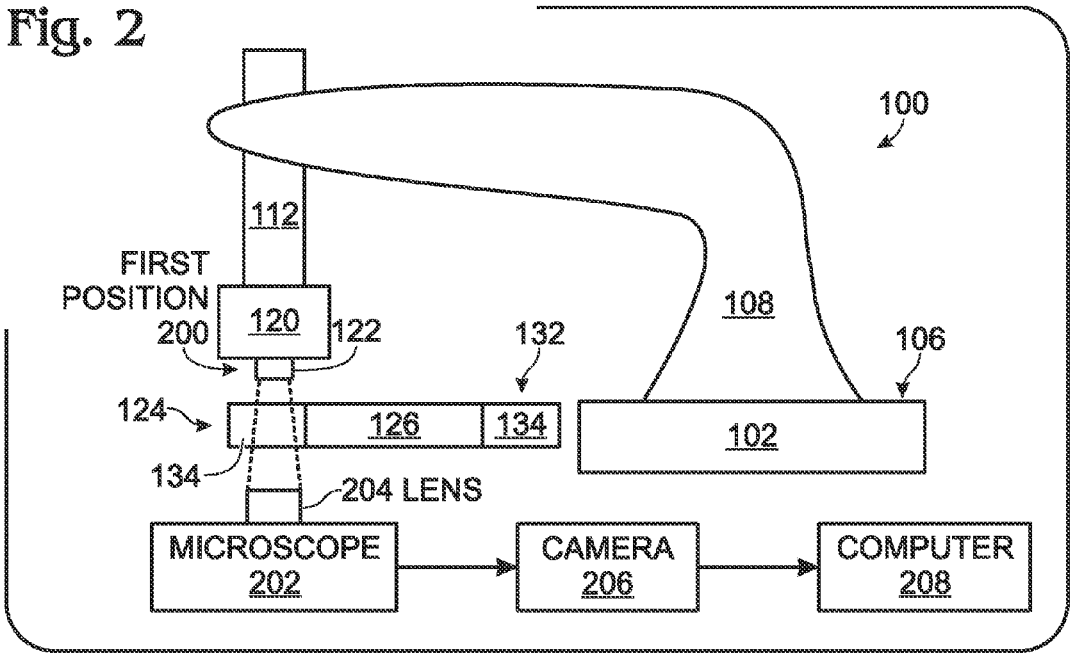
FIG. 2 is a partial cross-sectional view depicting the parallel polishing device performing an optical inspection.

FIG. 2 is a partial cross-sectional view depicting the parallel polishing device performing an optical inspection. The arm 108 and spindle 112 cooperate to move the metallurgical sample against the wheel inner diameter for polishing, as shown in FIGS. 1A and 1B, and to a first position 200 overlying the wheel outer diameter top surface 132 for in-situ inspection. The first position should coincide with the most recently polished surface of the sample 122. Note: the first position may change as the sample is polished. Alternately, the device compensates for sample polishing and maintains a consistent sample surface position.

In one aspect as shown, the optical system 138 includes a microscope 202 underlying the wheel outer diameter 134 with a lens 204 focused on the first position 200, through the wheel outer diameter 134. As shown, the microscope may be connected to a camera 206 so that the images may be recorded. In another aspect as shown, the camera may be connected to a computer 208 for image processing. Alternately, the images are recorded in a camera memory for subsequent viewing and processing. As another alternative, a camera may be used instead of a microscope.

Figure 3:
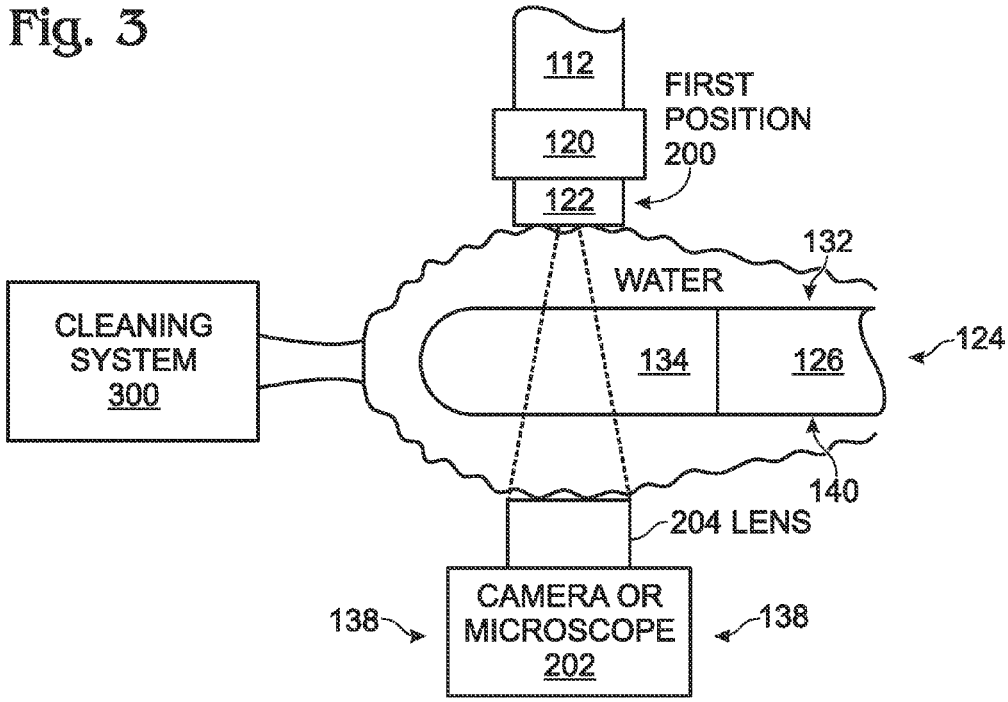
FIG. 3 is a partial cross-sectional view of the device of FIG. 1A with a cleaning system.

FIG. 3 is a partial cross-sectional view of the device of FIG. 1A with a cleaning system. The cleaning system 300 overlies the wheel outer diameter top surface 132 for spraying the wheel outer diameter 134 with cleaning solution to support an in-situ inspection. The cleaning may be preformed before an inspection or during an inspection. In one aspect as shown, the optical system 138 is a water immersion optical system with a lens 204 underlying the wheel outer diameter bottom surface 140, focused on the first position 200. The cleaning system 300 provides a continuous stream of water during in-situ inspection, between the wheel outer diameter top surface 132 and the first position 200, and between the wheel outer diameter bottom surface 140 and the lens 204. In this aspect the wheel outer, diameter 134 is a glass material. The glass material may be chosen to have an index of refraction that matches water, so that there is no change in the index of refraction between the lens and the sample 122. Alternately stated, glass has an index of refraction that is more similar to water than it is to air. Glass typically has an index of refraction of 1.5, while water is typically 1.3, and air is 1.0.

Figure 4:
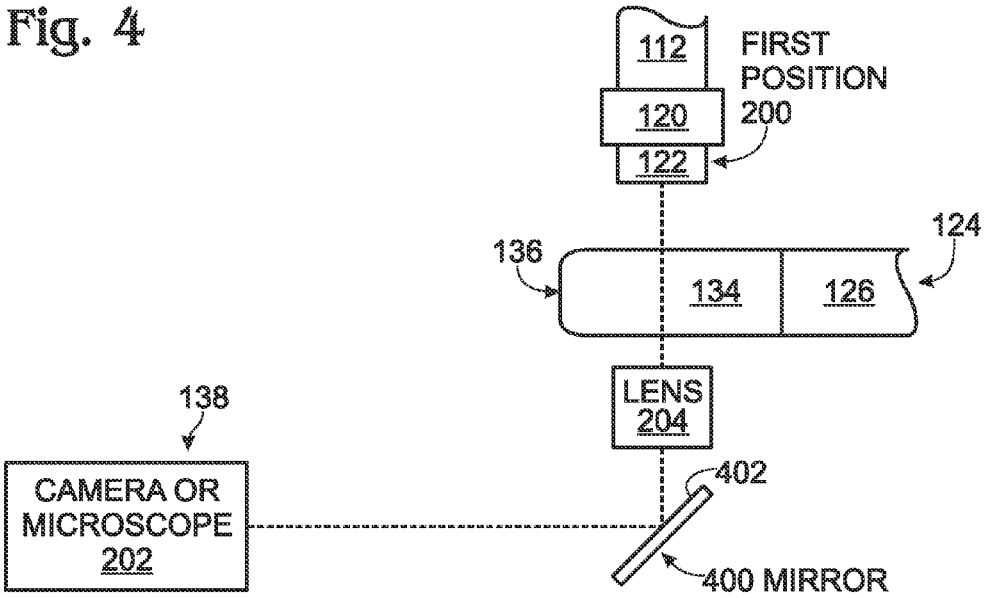
FIG. 4 is a partial cross-sectional view of the device of FIG. 1A using a first alternate optical system.

FIG. 4 is a partial cross-sectional view of the device of FIG. 1A using a first alternate optical system. In this aspect the optical system 138 includes a microscope 202 with a lens 204. The microscope underlies the wheel 124 and is outside the wheel outside edge 136. A mirror 400 underlies the wheel outer diameter 134 with a reflective surface 402. The lens 204, e.g., an objective lens, is focused on the first position 200, through the wheel outer diameter 134, interposed between the wheel 124 and the mirror reflective surface 402.

The working distance (focal length) of microscope lens is typically in the range from 1 to 10 mm. Some are longer (e.g., 25 mm), but the shorter the working distance, the better the image resolution. Thus, the focal length can be made short by keeping the lens as close to the wheel as possible. The optical system 138 is less sensitive to vibration with the objective lens being the first element. The rest of the optics (e.g., the microscope or camera) can be mechanically isolated so that vibrations are not coupled to the objective lens 204. Further, the microscope 202 is easier to use, being further removed from the polishing device 100. In addition, the further distance from the polishing device permits the microscope to remain free of cleaning and polishing agents. Note: the optical system may also include a camera instead of a microscope, or a camera and computer, as shown in FIG. 2. It should also be noted that the optical system may include additional lenses between the objective lens 204 and the microscope 202.

Figure 5:
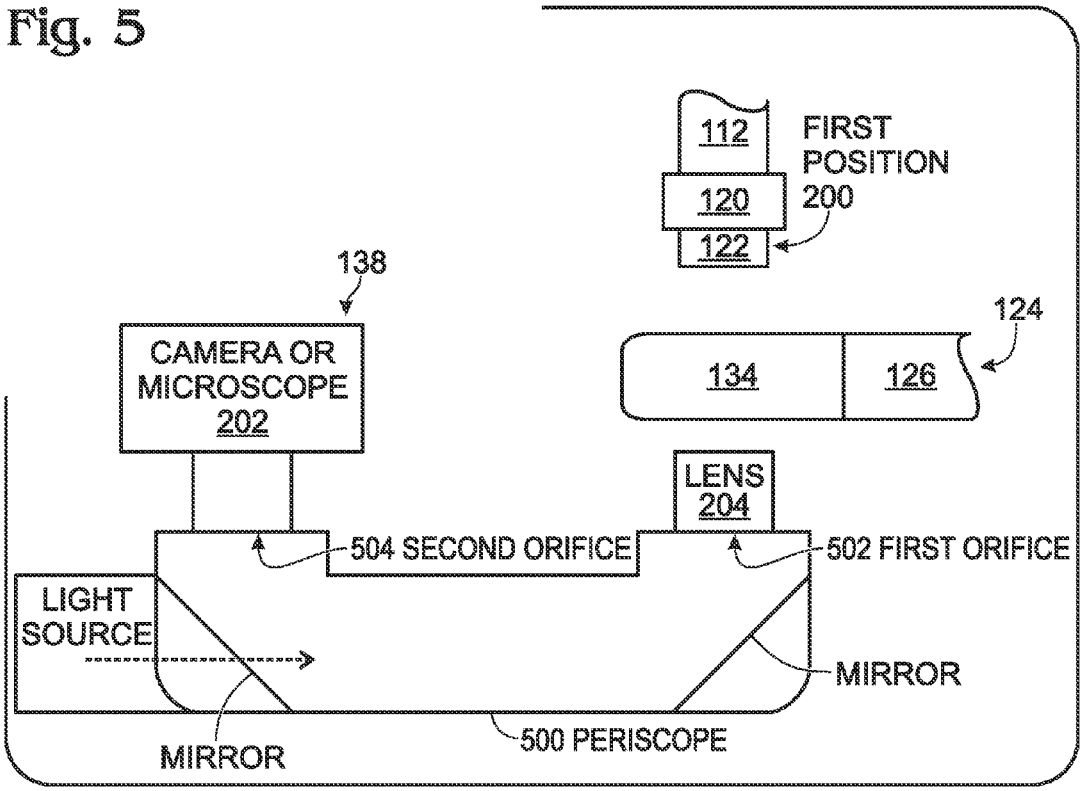
FIG. 5 is a partial cross-sectional view of the device of FIG. 1A using a second alternate optical system.

FIG. 5 is a partial cross-sectional view of the device of FIG. 1A using a second alternate optical system. In this aspect the optical system 138 includes a microscope 202 with a lens 204. A periscope 500 with a first orifice 502 underlies the wheel outer diameter 134. The periscope second orifice 504 interfaces the microscope 202. The microscope lens 204 is focused on the first position 200, through the wheel outer diameter 134, and is interposed between the wheel 124 and the periscope first orifice 502. Advantageously, the placement of the lens 204 shortens the microscope focal length, and the microscope 202 is easier to use, being further removed from the polishing device 100. In addition, the further distance from the polishing device permits the microscope to remain free of cleaning and polishing agents. Note: the optical system may also include a camera instead of a microscope, or a camera and computer, as shown in FIG. 2. It should also be noted that the optical system may include additional lenses between the objective lens 204 and the microscope 202.

Figure 6:
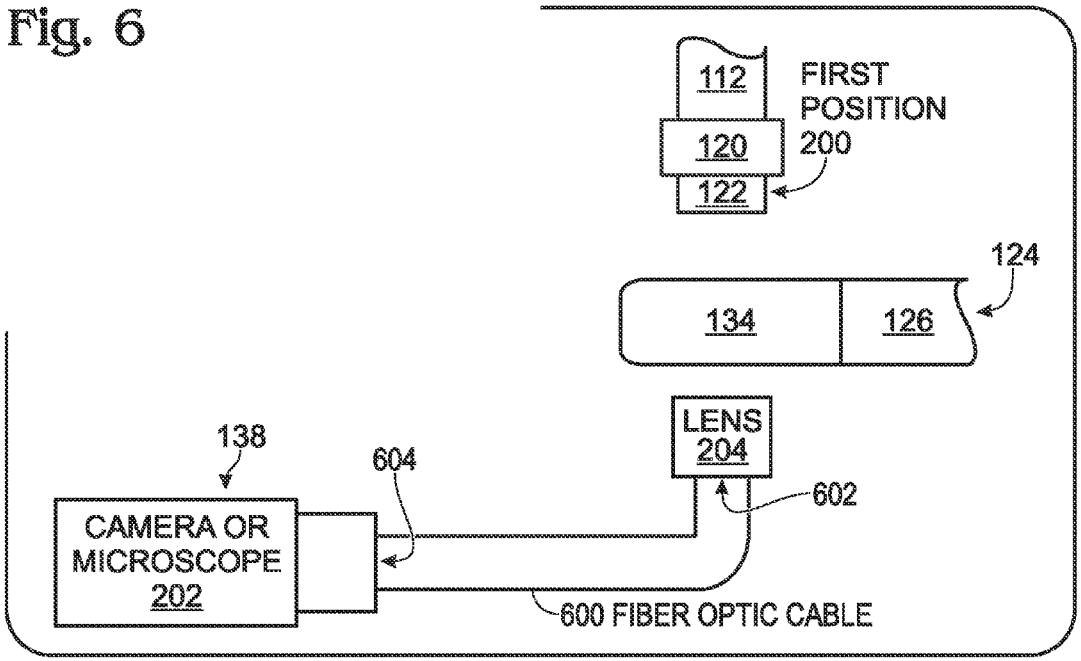
FIG. 6 is a partial cross-sectional view of the device of FIG. 1A using a third alternate optical system.

FIG. 6 is a partial cross-sectional view of the device of FIG. 1A using a third alternate optical system. In this aspect the optical system 138 includes a microscope 202 with a lens 204. A fiber optic cable 600 with a distal end 602 underlies the wheel outer diameter 134, and the cable proximal end 604 interfaces the microscope 202. The lens 204 is focused on the first position 200, through the wheel outer diameter 134, and is interposed between the wheel 124 and the fiber optic cable distal end 602. Advantageously, the placement of the lens 204 shortens the microscope focal length, and the microscope 202 is easier to use, being further removed from the polishing device 100. In addition, the further distance from the polishing device permits the microscope to remain free of cleaning and polishing agents. Note: the optical system may also include a camera instead of a microscope, or a camera and computer, as shown in FIG. 2. It should also be noted that the optical system may include additional lenses between the objective lens 204 and the microscope 202.

Functional Description

The devices of FIGS. 1A through 6 may be enabled using a ¼ inch glass wheel that is placed on the metal turntable. The metal turntable may have an 8 inch diameter, for example, and the glass wheel a 10 inch diameter. The glass wheel may be frosted (e.g., etched with Hydrofluoric acid to make it slightly rough) for only the inner 8-inch diameter. The outer 2-inch diameter of the glass wheel is not frosted, and therefore clear. The microscope looks through the clear glass outer diameter. For examination, the arm moves the sample over to the outer diameter. Otherwise, the polishing is performed within the inner 8-inch frosted area. Polishing compounds with various particle sizes can be added to the frosted area. A water spray located at the perimeter of the glass wheel is directed toward the middle of the wheel, which tends to keep the polishing compound in the middle 8-inch area.

The sample is polished in the middle 8 inches for a predetermined turns of the turntable, and then the arm moves the sample out to the edge for a picture. The water spray cleans the clear glass area for the picture. The objective lens is also in the water so it is an immersion lens and the water also keeps the lens relatively clean.

A computer may be connected to an imaging system camera. The computer processor may execute software instructions stored in memory for processing recorded images. For example, three pictures may be taken in sequence during one inspection cycle and compared. Debris particles tend to move and are unlikely to appear in every image. The software eliminates data from pixels that are very different from frame to frame. The pixels are different because the debris particles have moved. Otherwise, the three images should be identical. Similar algorithms are conventionally used to eliminate gamma ray particles that hit a CCD detector during long exposures. For example, two exposures are taken. If the pixel counts of the two images dramatically vary, the image with the high pixel count is eliminated and the image with the lower (more normal) pixel count is used. Alternately, three images may be captured and the two most similar images may be used. As another alternative a pixel-by-pixel comparison of the images may be performed to remove pixel variances and the images combined. Particles or debris can appear either darker or lighter in an optical image. Gamma ray hits are always brighter.

Figure 7:
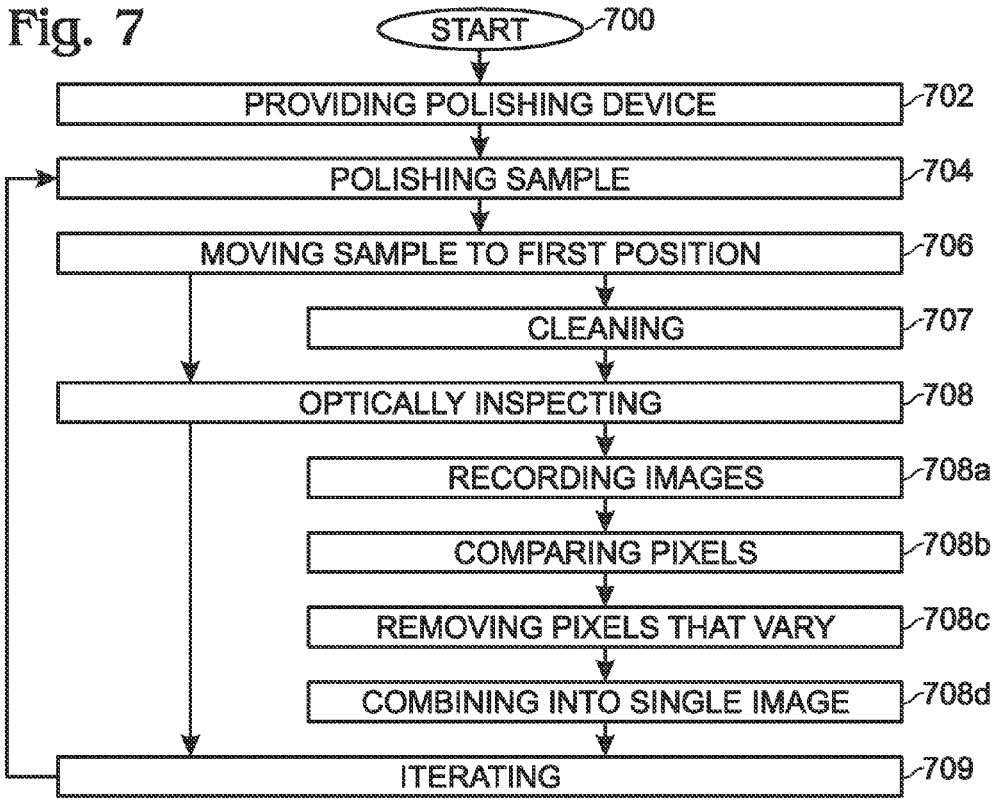
FIG. 7 is a flowchart illustrating a method for in-situ inspection optical inspection during a parallel polishing process.

FIG. 7 is a flowchart illustrating a method for in-situ inspection optical inspection during a parallel polishing process. Although the method is depicted as a sequence of numbered steps for clarity, the numbering does not necessarily dictate the order of the steps. It should be understood that some of these steps may be skipped, performed in parallel, or performed without the requirement of maintaining a strict order of sequence. Typically however, the steps are performed in numerical order. The method starts at Step 700.

Step 702 provides a polishing device with a spindle bit for holding a metallurgical sample, a rotatable wheel having an inner diameter with a top surface for accepting a polishing compound and a transparent outer diameter, and an optical system underlying the wheel outer diameter for recording images of the metallurgical sample. See FIGS. 1A through 6. Step 704 polishes the metallurgical sample against the wheel inner diameter. Step 706, without releasing the metallurgical sample from the spindle bit, moves the metallurgical sample to a first position overlying the wheel outer diameter. Step 708 optically inspects the metallurgical sample. For example, Step 708 may focus a microscope or camera lens on the first position, through the wheel outer diameter.

In one aspect, Step 702 provides a polishing device with a cleaning system overlying the wheel outer diameter. Then, Step 707 sprays the wheel outer diameter with cleaning solution to support an in-situ inspection. Note: Step 707 may be performed either before or during Step 708. In one aspect, Step 702 provides a polishing device with a glass wheel outer diameter, and an optical system with a lens underlying the wheel outer diameter, focused on the first position. Spraying the wheel outer diameter with cleaning solution in Step 707 includes supplying a continuous stream of water during the optical inspection, between a wheel outer diameter top surface and the first position, and between a wheel outer diameter bottom surface and the lens. Step 708 optically inspects the metallurgical sample through water and glass mediums having matching indices of refraction. As noted above, the refraction indices need not be an exact match, just that they provided a better match than glass and air.

In one aspect, Step 709 iteratively repeats the steps of polishing the metallurgical sample (Step 704), moving the metallurgical sample to the first position (Step 706), and optically inspecting the metallurgical sample (Step 708).

In another aspect, optically inspecting the metallurgical sample includes substeps. Step 708*a* records a plurality of images per inspection iteration. Step 708*b* compares pixel values between the images. Step 708*c* removes pixels with values that vary. Step 708*d* combines the remaining pixels into a single image. For example, three images may be recorded in Step 708*a*. Removing pixels with values that vary in Step 708*c* includes removing a first pixel in a first image with a value that does not match the first pixel values in a second and third image. Then, combining the remaining pixels into the single image in Step 708*d* includes combining the first pixels in the second and third images into a summed image first pixel.

A system and method to support parallel polishing with in-situ optical inspections has been provided. Explicit device details and process steps have been given as examples to illustrate the invention. However, the invention is not limited to just these examples. Other variations and embodiments of the invention will occur to those skilled in the art.

I claim:

1. A polishing device with an in-situ optical inspection system, the polishing device comprising:

a base;

an arm mounted on a top surface of the base, wherein the arm is moveable in a horizontal plane;

a spindle moveable in a vertical plane, wherein the spindle has a proximal end extending from the arm and a distal end;

a spindle bit attached to the distal end of the spindle configured to hold a metallurgical sample;

a rotatable wheel underlying the spindle bit having an inner diameter between a center of the rotatable wheel and an inner circumference, wherein the rotatable wheel has a top surface configured to accept a polishing compound, and a transparent outer diameter between the inner circumference and an outer edge of the rotatable wheel; and an optical system underlying the outer diameter of a bottom surface of the rotatable wheel, wherein the optical system is configured to view images of the metallurgical sample;

wherein the arm and the spindle cooperate to move the metallurgical sample, in the horizontal plane, between a first position overlying the inner diameter of the rotatable wheel for polishing, and a second position overlying the outer diameter of the rotatable wheel for in-situ inspection by the optical system.

2. The polishing device of claim 1, further comprising:

a cleaning system overlying the outer diameter of the rotatable wheel and configured to spray the rotatable wheel with cleaning solution.

3. The polishing device of claim 2, wherein the optical system is a water immersion optical system with a lens underlying a bottom surface of the outer diameter of the rotatable wheel, wherein the lens is focused on the second position.

4. The polishing device of claim 1, wherein the optical system comprises:

a microscope with a lens, wherein the microscope underlies the rotatable wheel and resides outside an outside edge of the rotatable wheel; and a mirror that underlies the outer diameter of the rotatable wheel, wherein the mirror has a reflective surface.

5. The polishing device of claim 1, wherein the optical system comprises a camera configured to record the images.

6. The polishing device of claim 3, wherein the cleaning system provides a continuous stream of water, during the in-situ inspection, between a top surface of the outer diameter of the rotatable wheel and the second position, and between the bottom surface of the outer diameter of the rotatable wheel and the lens.

7. The polishing device of claim 1, wherein the outer diameter of the rotatable wheel is a glass material.

8. The polishing device of claim 4, wherein the lens is focused on the second position through the outer diameter of the rotatable wheel, and is interposed between the rotatable wheel and the reflective surface of the mirror.

9. A system for performing metallurgical polishing with in-situ inspection, comprising:

means for holding a metallurgical sample against a rotatable wheel having an inner region for polishing the metallurgical sample and a transparent outer region that extends from a circumference of the inner region to an edge of the rotatable wheel;

means for moving the metallurgical sample from a first position over the inner region during a polishing phase to a second position over the transparent outer region during an inspection phase; and means for recording an image of the metallurgical sample through the transparent outer region at a time during which the metallurgical sample is in the second position.

10. The system of claim 9, further comprising means for spraying a cleaning solution on a top surface of the outer region of the rotatable wheel.

* * * * *